US009061819B2

(12) United States Patent
Kane, Jr. et al.

(10) Patent No.: US 9,061,819 B2
(45) Date of Patent: Jun. 23, 2015

(54) MULTIPLE COMPARTMENT POUCH OR CONTAINER WITH FRANGIBLE SEAL

(75) Inventors: James P. Kane, Jr., Wilmington, DE (US); I-Hwa Lee, Wilmington, DE (US); Donna Lynn Visioli, Lower Gwynedd, PA (US); Jose Tirso Olivares-Cordoba, Chicago, IL (US); James A. Shoemaker, Chicago, IL (US)

(73) Assignees: E I DU PONT DE NEMOURS AND COMPANY, Wilmington, DE (US); Kornick Lindsay

( * ) Notice: Subject to any disclaimer, the term of this patent is extended or adjusted under 35 U.S.C. 154(b) by 1148 days.

(21) Appl. No.: 11/809,727

(22) Filed: May 31, 2007

(65) Prior Publication Data

US 2007/0278114 A1 Dec. 6, 2007

Related U.S. Application Data

(60) Provisional application No. 60/809,869, filed on Jun. 1, 2006.

(51) Int. Cl.

| | |
|---|---|
| ***B65D 81/32*** | (2006.01) |
| ***B65D 25/08*** | (2006.01) |
| ***B65D 75/58*** | (2006.01) |
| *B65D 75/00* | (2006.01) |

(52) U.S. Cl.

CPC ..... *B65D 81/3266* (2013.01); *B65D 25/08* (2013.01); *B65D 75/008* (2013.01); *B65D 75/5883* (2013.01)

(58) Field of Classification Search

CPC ..... B65D 81/3266; B65D 25/08

USPC ..... 206/219, 220, 221, 222, 568, 107; 215/6, DIG. 8; 383/38, 40, 210, 211, 383/104, 109, 906; 493/197, 198, 200, 202, 493/208

See application file for complete search history.

(56) References Cited

U.S. PATENT DOCUMENTS

| | | | | |
|---|---|---|---|---|
| 2,245,738 | A * | 6/1941 | Taylor | 206/568 |
| 3,390,507 | A * | 7/1968 | Repko | 53/412 |
| 3,608,709 | A | 9/1971 | Pike | |
| 3,964,604 | A | 6/1976 | Prenntzell | |

(Continued)

FOREIGN PATENT DOCUMENTS

| | | |
|---|---|---|
| DE | 77 23 214 U1 | 10/1977 |
| DE | 20209034 U1 | 10/2002 |

(Continued)

OTHER PUBLICATIONS

PCT International Search Report for International Application No. PCT/US2007/012508 dated Nov. 14, 2007.

(Continued)

*Primary Examiner* — Khoa Huynh
*Assistant Examiner* — Sharon M Prange

(57) ABSTRACT

A polymeric film, multiple-compartment container having an internal frangible seal comprising a curved portion and variable width with a maximum width near the portion of the curve having the smallest radius of curvature, for confining a fluid and related beverage container with a re-closable fitment for storing and delivering two different flavored liquids or the like. The frangible seal of the container will burst when sustained squeezed thus allowing the components in the container to mix within the container.

20 Claims, 4 Drawing Sheets

(56) References Cited

U.S. PATENT DOCUMENTS

| | | | | |
|---|---|---|---|---|
| 4,539,263 | A | 9/1985 | Hoh | |
| 4,550,141 | A | 10/1985 | Hoh | |
| 4,602,910 | A | 7/1986 | Larkin | |
| 4,608,043 | A | 8/1986 | Larkin | |
| 4,787,511 | A * | 11/1988 | McIver | 206/219 |
| 5,114,004 | A | 5/1992 | Isono | |
| 5,195,658 | A * | 3/1993 | Hoshino | 222/92 |
| 5,209,347 | A * | 5/1993 | Fabisiewicz et al. | 206/219 |
| 5,287,961 | A | 2/1994 | Herran | |
| 5,423,421 | A | 6/1995 | Inoue | |
| 5,425,587 | A | 6/1995 | Takiguchi | |
| 5,431,496 | A * | 7/1995 | Balteau et al. | 383/38 |
| 5,492,219 | A | 2/1996 | Stupar | |
| 5,860,743 | A | 1/1999 | Larkin | |
| 5,873,656 | A | 2/1999 | Arkins | |
| 5,898,050 | A | 4/1999 | Shih | |
| 5,928,213 | A | 7/1999 | Barney et al. | |
| 5,944,709 | A | 8/1999 | Barney | |
| 5,954,230 | A | 9/1999 | Blette | |
| 6,007,529 | A | 12/1999 | Gustafsson | |
| 6,024,220 | A | 2/2000 | Smith | |
| 6,039,720 | A | 3/2000 | Wieslander | |
| 6,076,968 | A | 6/2000 | Smith | |
| 6,116,782 | A | 9/2000 | Arkins | |
| 6,117,123 | A | 9/2000 | Barney | |
| 6,138,849 | A | 10/2000 | Roemer | |
| 6,164,822 | A | 12/2000 | Beer | |
| 6,164,825 | A | 12/2000 | Larkin | |
| 6,186,998 | B1 | 2/2001 | Inuzuka | |
| 6,398,771 | B1 * | 6/2002 | Gustafsson et al. | 604/410 |
| 6,476,137 | B1 | 11/2002 | Longo | |
| 6,612,428 | B1 | 9/2003 | Segovia | |
| 6,655,837 | B2 | 12/2003 | Matsuda | |
| 6,669,013 | B1 | 12/2003 | Villanueva | |
| 6,682,517 | B1 | 1/2004 | Ezaki | |
| 6,743,451 | B2 * | 6/2004 | Rasile et al. | 426/112 |
| 6,866,145 | B2 | 3/2005 | Richards | |
| 6,929,399 | B2 * | 8/2005 | Nokura | 383/38 |
| 6,945,394 | B2 * | 9/2005 | Segovia et al. | 206/219 |
| 6,998,157 | B2 | 2/2006 | Glick | |
| 7,055,683 | B2 | 6/2006 | Bourque | |
| 7,597,691 | B2 * | 10/2009 | Kawaguchi et al. | 604/408 |
| 2002/0166779 | A1 | 11/2002 | Etesse | |
| 2003/0148004 | A1 * | 8/2003 | Kawaguchi et al. | 426/115 |
| 2004/0118710 | A1 | 6/2004 | Bourque | |
| 2004/0134802 | A1 * | 7/2004 | Inoue et al. | 206/219 |
| 2004/0238564 | A1 | 12/2004 | Bourque | |
| 2006/0093765 | A1 * | 5/2006 | Mueller | 428/35.2 |
| 2007/0261974 | A1 * | 11/2007 | Balteau et al. | 206/219 |

FOREIGN PATENT DOCUMENTS

| | | | |
|---|---|---|---|
| EP | 1010642 | A1 | 6/2000 |
| EP | 0541715 | B2 | 6/2004 |
| EP | 1 520 800 | A1 | 4/2005 |
| WO | WO 99/24086 | A1 | 5/1999 |
| WO | WO 99/51509 | A1 | 10/1999 |
| WO | WO 01/00502 | A1 | 1/2001 |
| WO | WO 02/078885 | A1 | 10/2002 |
| WO | WO 03/068631 | A2 | 8/2003 |

OTHER PUBLICATIONS

Eva Backman, et al., Isometric Muscle Force and Anthropometric Values in Normal Children Aged Between 3.5 and 15 Years, Scand J Rehab Med 21, 1989, 105-114.

Sheik N. Imrhan, et al., Trends in Finger Pinch Strength in Children, Adults, and the Elderly, Human Factors, 1989, 689-701, 31(6), The Human Factors Society, Inc.

* cited by examiner

MULTIPLE COMPARTMENT POUCH OR CONTAINER WITH FRANGIBLE SEAL

This application claims priority to U.S. provisional application Ser. No. 60/809,869, file Jun. 1, 2006, entire disclosure of which is herein incorporated by reference.

The invention relates to a pouch or container with an internal frangible seal to allow mixing of components in the pouch.

BACKGROUND

It is generally known in the art to use a flexible plastic pouch for packaging a variety of products. It is also generally known in the art that a frangible seal can be produced between heat-sealable films. For example, U.S. Pat. Nos. 4,539,263 and 4,550,141 disclose blends of partially neutralized ethylene/acid copolymer with minor amounts of propylene/acid copolymer to make heat-sealable films and laminates. Such structures are characterized by nearly constant peel strength over an extended heat seal temperature range. The blends are useful to manufacture heat-sealed flexible film packages having a seal of predictable and constant peel strength, in spite of inevitable variations in the heat seal temperature used in the production of such packages.

Pouches having curved frangible seals are known. For example, U.S. Pat. No. 6,743,451 discloses a dual compartment recloseable bag for marinading food formed from a flexible plastic sheet and a flexible foil sheet having an arcuate rupturable seal. U.S. Pat. No. 5,944,709 discloses a flexible container for storage and mixing together of diluents and medicaments in which the container has a peelable seal that includes a rectangular portion and a curvilinear portion that comprises an arcuate section surmounting the rectangular portion. Also U.S. Pat. Nos. 5,928,213 and 6,117,123 disclose a flexible container for storage and mixing together of diluents and medicaments in which the container has a peelable seal with a sinusoidal shape with at least one stress riser.

Accordingly, there is a need to develop a multiple-compartment container that can be easily filled using conventional commercial equipment, have an internal frangible heat-seal capable of being ruptured by a sustained manual squeeze with the outer perimeter of the multiple compartment remaining intact, and be robust enough to withstand conventional shipment and customer handling.

SUMMARY OF THE INVENTION

The invention provides a flexible multiple-compartment pouch comprising (1) a single sheet of polymeric film or multi-sheet of polymeric film and (2) at least one frangible seal wherein the single sheet is folded back on itself and sealed along essentially three sides, or the superimposed edges, directly or indirectly through a third intervening polymeric film thereby defining a sealed perimeter and forming a closed pouch;

the multi-sheet comprises at least a first sheet of polymeric film and a second sheet of polymeric film;

the second sheet is superimposed on the first sheet;

the first sheet and the second sheet are sealed to each other directly or indirectly through a third intervening polymeric film thereby defining a sealed perimeter and forming a closed pouch;

the frangible seal is internal to the sealed perimeter and the at least one frangible seal divides the closed pouch into separated compartments comprising a first compartment and a second compartment;

the at least one frangible seal comprises a curved portion and variable width with a maximum width near the segment of the curve having the smallest radius of curvature;

the first compartment comprises or confines a fluid;

the second compartment comprises or confines another ingredient; and the seal strength of the sealed perimeter is sufficient to withstand manual compression of the fluid and the seal strength of the at least one frangible seal is insufficient to withstand manual compression of the fluid, thus allowing the fluid to commingle with the contents of the second compartment.

DETAILED DESCRIPTION OF THE INVENTION

Figure 3:
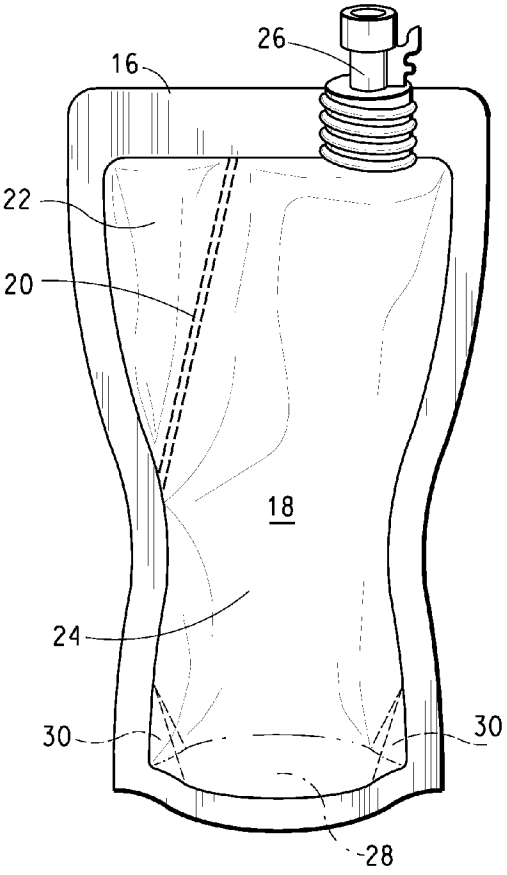
FIG. 3 represents a frontal perspective view of an alternate stand-up embodiment of the two separate compartment flexible container.

Although the application is predominantly disclosed and illustrated in the preferred form or embodiment of a flexible, multi-compartment beverage pouch, the underlying concepts and functionality of the invention are generally applicable to any flexible film pouch packaging system wherein a fluid (i.e., liquid, gas, paste, gel, slurry, or the like) is to be temporarily confined to a separate compartment until a frangible seal is ruptured by application of a manual compression of the flexible pouch; thus allowing the confined fluid to commingle with the contents of the adjacent and separate compartment. The concept of a beverage pouch include not only drinks such as juice, milk, tea and the like but also include yogurt and even more viscous fluids such as custards. As such, the concepts of selecting a polymeric film or multi-layered film, sealing the perimeter of a pouch and forming a frangible seal dividing the pouch into separate compartments are all aspects of the invention common to both pouch and beverage container embodiments.

A curve is a line that deviates from straightness in a smooth, continuous fashion. A simple curve is a curve that does not cross itself. A curve can be considered as the combination of a number of arcs, each defined by its length and its radius of curvature. An arc forming a segment of a curve can be considered as collinear with the circle of curvature (the circle that touches a curve on the concave side and whose radius is the radius of curvature) for that segment of the curve. The "width" of a curve is related to its radius of curvature. A "curve of constant width", such as circle or portion of a circle, has a single radius of curvature. As used herein, the width of a curve is not to be confused with the width of a frangible seal that follows the path of the curve.

Curvature is the ratio of the change in the angle of a tangent that moves over a given arc to the length of that arc. A "sharp" curve has a relatively large change in angle over a short arc. The overall directional turn of a curve can be determined by measuring the angle formed by the tangents at the ends of the curve.

A curve that changes from, for example, concave upwards to concave downwards has an inflection point, a point where the tangent crosses the curve itself. Serpentine, S-curves and sinusoidal curves are examples of curves with at least one inflection point.

A frangible seal in multi-compartment containers can have two conflicting performance requirements. First, it provides a relatively strong resistance to a force generated during normal shipping, storage and handling in order to avoid inadvertent rupture of the seal. Operational use of a container requires that the frangible seal survive various impacts during the product's lifetime. Various impact events may occur during which a frangible seal is susceptible to rupture with subsequent product activation. In order to reduce the risk of unanticipated activation, an effective multi-compartment container may be constructed with a frangible seal strong enough to resist the pressure excursions of most inadvertent impacts, yet yield to the pressures of intentional manipulation during user activation to effect rupture of the frangible seal. Secondly, the seal peels substantially completely apart during user activation, thus avoiding any subsequent restriction of the flow path between communicating chambers. With known frangible seals, there is a finite possibility that the seal incompletely peels apart along its entire length during activation. This may allow certain or even substantial amounts of the compartment contents, either before or after mixing, to remain trapped against the unopened seal line sections.

Figure 2:
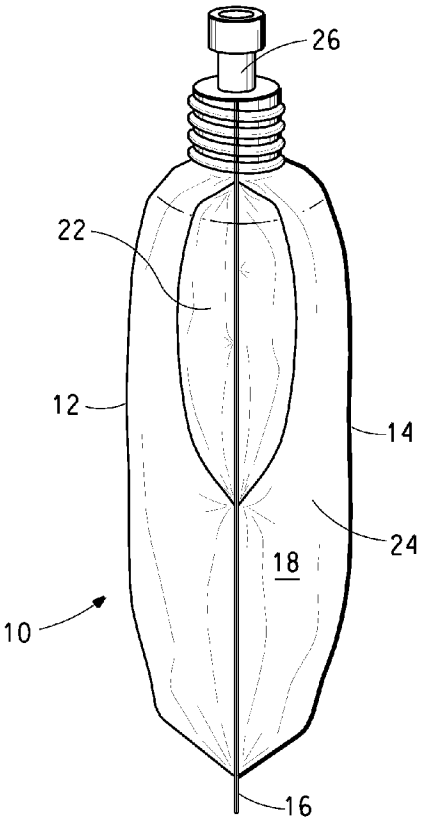
FIG. 2 represents a left side view of the embodiment of FIG. 1 as seen through line 2-2.
Figure 1:
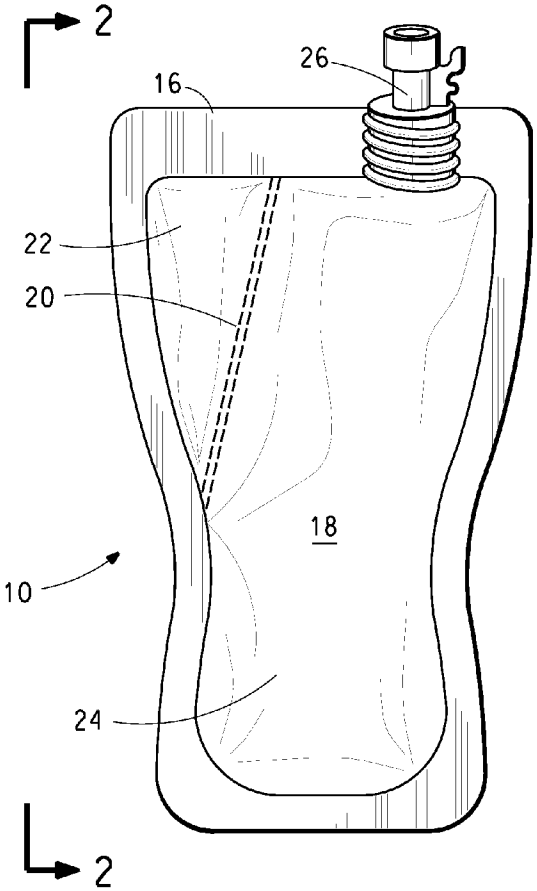
FIG. 1 represents a frontal perspective view of a two separate compartment, flat film, embodiment of the flexible container.

As illustrated in FIGS. 1 and 2, the flexible container, such as a beverage container (generally reference numeral 10) can involve two superimposed sheets 12 and 14 (see FIG. 2) of polymeric film circumferentially sealed at the perimeter or edge 16, thus forming a pouch 18 or a single sheet of film (not shown) folded back on itself and sealed along essentially three sides to close the pouch. Internal to the pouch 18 is a frangible seal located at 20 (see FIG. 1) dividing the beverage container 10 into two separated compartments 22 and 24. The shape of the frangible seal is further disclosed below. The perimeter of the pouch has a first end 32, a second end 34, and opposed sides 36 and 38. The container is also optionally equipped with means for accessing the contents of the pouch, such as an insertion area for a straw or, as shown, a fitment 26 integrally sealed in the upper portion (the first end 32) of the perimeter 16 of the pouch 18.

FIG. 3 illustrates an alternate embodiment of a flexible container 10 in the form of a two-compartment stand-up flexible film pouch. The respective elements comprising this embodiment are identified by using the corresponding reference numerals employed in describing the container illustrated in FIG. 1 and 2. This embodiment differs from the previous container of FIG. 1 and 2 in that the second end 34 has a bottom 28 and involves a folded gusset structure 30 allowing the beverage container 10 with beverage to be freestanding. At the opposed sides, the sheets can be sealed without gussets. Such an embodiment may involve a more complex perimeter seal and/or folding configuration to create the gusset 30 and bottom surface 28.

Figures 4A, 4B, 4C:
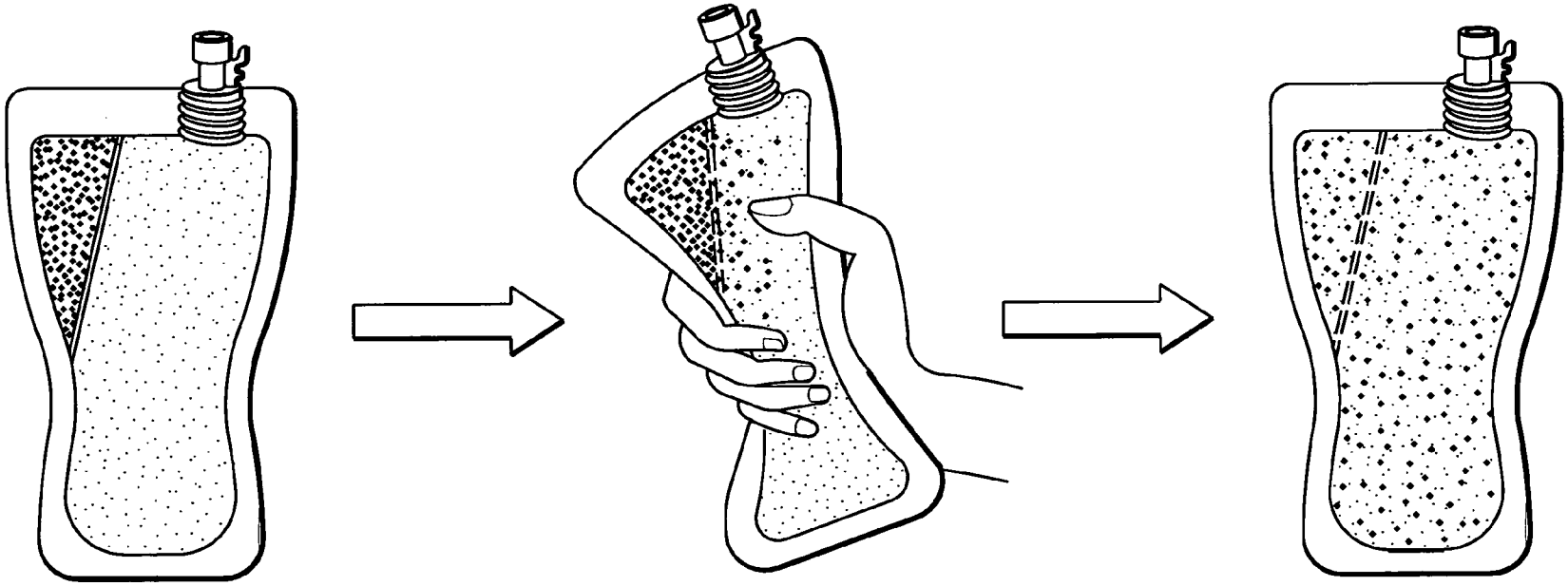
FIG. 4A through 4C represent a perspective view of how one can sequentially use the flexible container or beverage pouch.

As sequentially illustrated in FIG. 4A through 4C, a flexible two-compartment container illustrated in FIG. 1 prior to manual compression confines a second beverage, flavoring concentrate, other ingredient such as a fizzing agent and/or colorant, or the like to the smaller separated compartment isolated from the beverage in the larger compartment. Upon manually squeezing the flexible beverage pouch, the force required to rupture the frangible seal between the two compartments is exceeded. Consequently, the frangible seal opens and the contents of the two previously separated compartments commingle. At the same time, the outer sealed perimeter of the beverage container remains intact in the face of this manual pressure. Thus drinking from the beverage container through the re-closable fitment after squeezing produces a different flavor or effect than when drinking from the container before rupturing the frangible seal.

Figure 7:
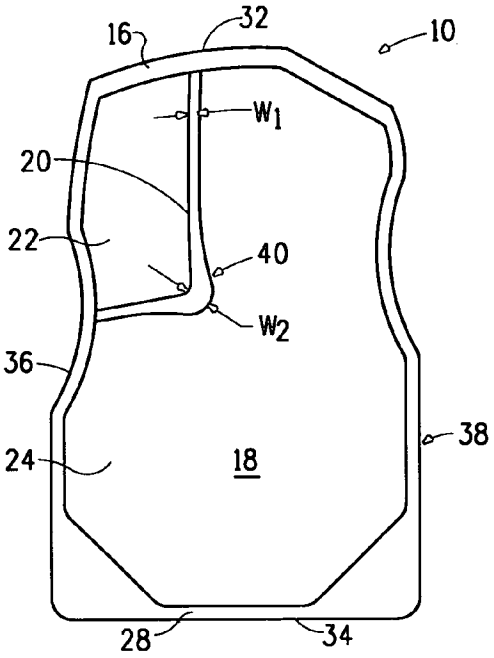
FIG. 5-7 represent flat frontal views of geometric configurations of a stand-up flexible film pouch having a first end, a second end, and two opposed sides, less fitment, prior to being filled. In these Figures, the frangible seal extends from the first end of the pouch to one of the opposed sides.
Figure 6:
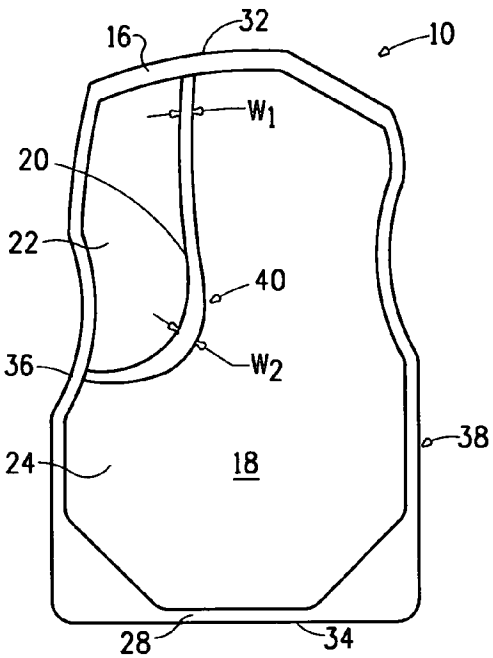
Figure 5:
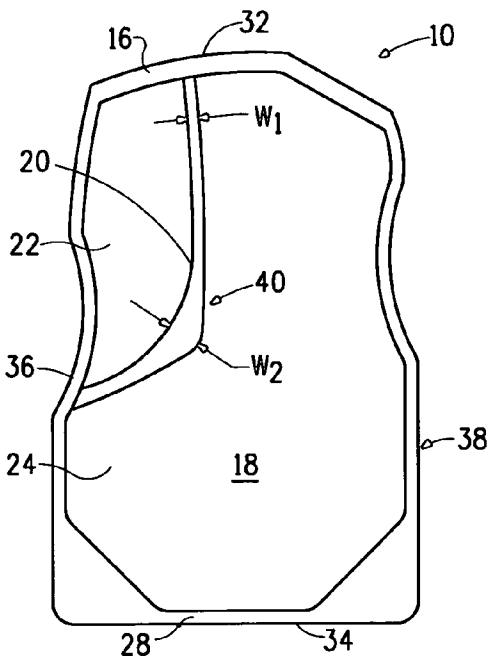

Wishing not to be bound by theory, the principle aspects employed in designing and constructing a flexible multiple compartment pouch and corresponding beverage container are shown in FIG. 5 to 7 (typical configurations for the frangible seal within a two compartment flexible beverage pouch intended to be freestanding with a folded gusset structure creating a bottom surface for supporting the pouch in an upright position.

As illustrated, FIG. 5 through 7 represent the geometrical configurations of a folded and flat polymeric film pouch prior to being filled with a fluid or beverage and less the fitment or other closure with three different variants of the frangible seal. Also, the slightly sloped outer perimeter segment at the top right edge of the larger chamber is intended to accommodate an optional fitment or the like (not shown). Each pouch has a first end 32, a second end 34 and two opposed sides 36 and 38. In these pouches, the frangible seal 20 extends from the first end 32 to one of the opposed sides, as illustrated side 36. For illustration purposes, FIG. 5 shows a frangible seal with a relatively large radius of curvature (about 1.8 inches); FIG. 6 shows a frangible seal with an intermediate radius of curvature (about 0.6 inches), and FIG. 7 shows a frangible seal with a very small radius of curvature (less than 0.1 inches). Using these configurations wherein the lines represent permanent seals, frangible seals or folds in the sheet (as appropriate), a finite element model analysis can be performed on the respective pouch configuration when filled with an incompressible liquid. The finite element model analysis can be performed at three different pressure increases within the closed pouch; i.e., 1.0 psig, 1.5 psig, and 2.0 psig. The resulting force per unit length of seam exerted along the frangible seal can be computed as a function of the relative distance exerted along the seam of the frangible seal (i.e., arbitrary linear units based on the relative resolution or grid of the finite element analysis). The force along the frangible seal can be influenced by the geometry (such as curvature) of the frangible seal and the magnitude of this force can be a function of the pressure induced by squeezing the pouch. The peel characteristics of conventional straight frangible seals exhibit a curved peel front when the seal is examined after having been only partially peeled-open. This curved peel front indicates that the hydraulic pressure forcing the seal open is greatest in approximately the center of the seal, and decreases uniformly, but in accord with a power law outwardly toward the ends of the seal. A partially peeled-open conventional straight seal would have a concave separation pattern, with the deepest portion of the concavity being approximately in the center of the seal, corresponding to the curvilinear pressure gradient of the incompressible fluid that forces the seal open. It may, therefore, be easily seen that frangible seals will tend to naturally open soonest in the central region of the seal, and tend to remain closed along the sides of the seal, particularly where the frangible seal contacts the perimeter seal.

A smoothly curved frangible seal configuration exhibits higher peel force at a given pressure rise relative to a straight line configuration for the frangible seal and also shows localization of this increased force. In view of this, the physical curvature and shape of the frangible seal may become a means to concentrate the force for selectively exceeding the seal strength of the frangible seal. Thus the force concentrating means for selectively exceeding seal strength has a broad range of equivalents essentially including any intentional deviation from a straight-line frangible seal.

The frangible seal is shaped such that the curve has at least one portion that protrudes into the first compartment containing a fluid, such as a beverage or liquid diluent, wherein the convex leading edge of the curve defines an initiation region 40, where the frangible seal begins to rupture in response to a pressure event in the compartment towards which the initiation region is oriented. Finite element analysis of a developing pressure front caused by manipulating the compartment against a non-linear barrier, such as a curved frangible seal, reveals that forces due to the pressure change are concentrated in the region of the smallest radius of curvature extending toward the direction of the pressure front. This concentrated force due to the pressure change tends to preferentially initiate seal rupture in that region. The shape of the curve provides a force concentrator with its initiation region oriented in the direction of the anticipated pressure front. A curved seal tends to initiate the peel rupture of the seal at a lower nominal manipulation pressure than if the seal were straight.

Although the frangible seal has been disclosed as having initiation regions defined by convex curvatures, it is not necessary that the shape of the seal be defined with any particular regularity. Again, wishing not to be bound by theory and as noted above, application of finite element analysis reveals that initiation of seal rupture is enhanced as the radius of curvature becomes smaller. Finite element analysis indicates that as the initiation region reduces to an actual point, as would be the case in a saw-tooth or chevron configuration, peel initiation is maximized (that is, less force is required). In such a situation, however, the force required to initiate rupture may likely be so low as to cause the frangible seal to inadvertently open under the stresses of ordinary container handling. In contrast, if the radius of curvature of the initiation region is unduly large, the configuration of the frangible seal would more resemble a conventional straight seal that would substantially forego the benefits of an enhanced initiation region. However, lower force concentration and rupture over relatively longer distance may possibly ensure better, easier, and/or faster mixing of the contents of separated compartments. To minimize the unintentional opening of the frangible seal under normal handling such as shipping, storage and the like, the frangible seal may have a variable width (for example, the width can vary from about 0.01 to about 1 or about 0.1 inch to about 0.4 inch) such that the width has a maximum ($w_2$) near the portion of the curve having the smallest radius of curvature, at the initiation region 40. In other regions of the frangible seal, the width $w_1$ is less than $w_2$. Since most pressure excursions arising from stresses of normal handling are transient and of short duration, the maximum seal width $w_2$ provides protection of the initiation region against inadvertent rupture. When a user intends to rupture the seal, the user applies sustained manual compression to the first compartment containing a fluid, causing the initiation region to rupture.

The intersections of the frangible seal and the perimeter seal can also be described in terms of curves in which the radii of curvature are arbitrarily small compared to the radius of curvature of the initiation region in the main part of the frangible seal. As such, those intersections can function as additional force concentrators. As indicated above, the pressure resulting from compression of the fluid-containing compartment is lowest at the ends of the frangible seal. However, sufficient pressure may impinge on the ends to initiate rupture of the frangible seal at the ends as well as the middle. While this may facilitate complete opening of the frangible seal, it may be necessary to design the ends of the frangible seal so that the ends of the seal do not inadvertently open under the stresses of ordinary container handling. The likelihood of inadvertent opening of the ends of the frangible seal is highest if the intersection of the frangible seal and the perimeter seal forms a very acute angle whose vertex is directed toward the compartment most likely to have a compression event. In such cases, inadvertent rupture of the frangible seal under ordinary handling may occur at one of the ends and not in the middle. Accordingly, it is desirable that the frangible seal intersects the perimeter seal at an angle between 70 and 110 degrees, for example between 80 and 100 degrees, to minimize the force concentration in that region of the frangible seal. Again, wishing not to be bound by theory, angles more acute than 70 degrees may provide too sharp a curve and increase the chances of inadvertent seal rupture at the intersection. It is also desirable that the frangible seal near the intersection is shaped with a finite radius of curvature and/or increased width.

Figure 8:
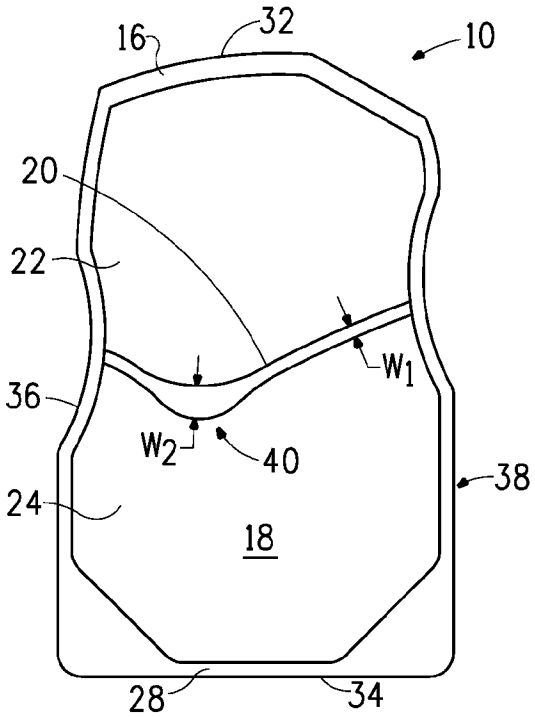
FIG. 8 represents a flat frontal view of a geometric configuration of a stand-up flexible film pouch having a first end, a second end, and two opposed sides, less fitment, prior to being filled. In this Figure, the frangible seal extends from one opposed side to the other opposed side.

FIG. 8 illustrates a stand-up pouch similar to those in FIG. 5-7, except that the frangible seal 20 extends from one opposed side 36 to the other opposed side 38.

Figure 9:
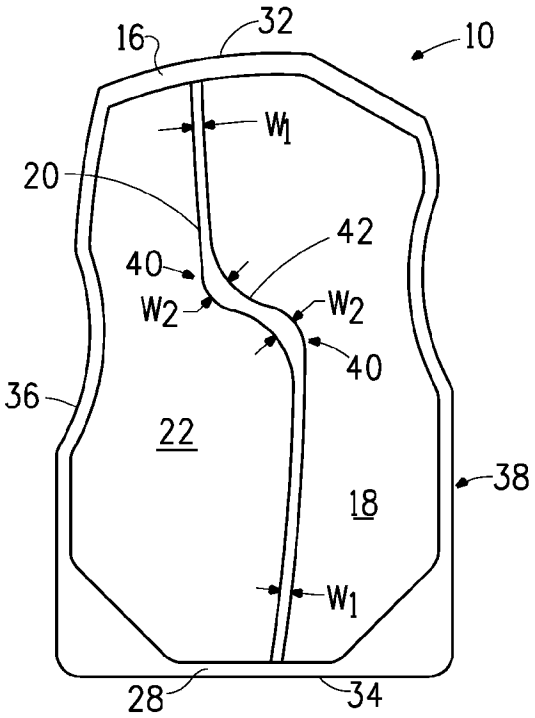
FIG. 9 represents a flat frontal view of geometric configurations of a flexible film beverage pouch having a first end, a second end, and two opposed sides, less fitment, prior to being filled. In this Figure, the frangible seal extends from said first end to said second end.

FIG. 9 illustrates a pouch in which the frangible seal 20 extends from the first end 32 to the second end 34. The frangible seal in FIG. 9 is formed as a curve with an inflection point. The resulting curve provides for two rupture initiation regions 40 on either side of the inflection point.

The curved frangible seal provides a shape that interacts with the curved pressure gradient of the incompressible fluid that forces the seal open to facilitate rupture of the frangible seal. The curved initiation regions combined with variable seal width provide means for adjusting the seal rupture profile so that the seal ruptures at a desired sustained pressure, opening uniformly along its entire length, yet remains robust enough to prevent unintended rupture during handling.

The specific shape, radii of curvature, depth of chord and variation in width of the frangible seal is, therefore, a matter of design choice and may vary with the length of the seal and the particular application to which the multi-compartment container is put, including the anticipated pressure of any inadvertent impacts and the desired pressure for intentional rupture. Specific seal shapes may be suitably designed using finite element analysis and suitably determining the desired opening pressure for the seal.

For example, to establish the acceptable utility of such structures in youth applications, the frangible seal may rupture easily at approximately a manually induced pressure rise of about 1.0 psig (i.e., preferably within the range of about 0.5 to about 2.0 psig sustained pressure rise), consistent with what is generally known and published relative to the hand strength of children. See for example, "Isometric Muscle Force and Anthropometric Values in Normal Children Aged Between 3.5 and 15 Years", Bäckman et al., Scand J Rehab Med 21: 105-114, 1989 and "Trends in Finger Pinch Strength in Children, Adults, and the Elderly", Imrhan et al., Human Factors, 31(6), 689-701, 1989. However, in pouch applications and adult beverage applications the acceptable manual sustained pressure rise range may approach 10 to 12 psig.

Accordingly, individual beverage containers for youth may be constructed and manufactured using a frangible seal having seal strength below the peak imposed peel force achieved by manually compressing the pouch. In other words, the frangible seal may be constructed such as to withstand imposed forces that are inherently experienced during shipment, handling, and storage but not to withstand the imposed force associated with that experienced by sustained manual squeezing of the pouch. The polymer film or sheet strength of the walls of the pouch must withstand even the manual application of compression. And, the perimeter seals most preferably may be a lock-up heat seal or the like; i.e., corresponding to the strength required for elongation or tearing of the film or sheet in peeling apart and/or rupturing the outer perimeter seals apart. However, while a lock up seal is disclosed for the perimeter, the perimeter seals may have high seal strengths without necessarily being lockup, if the frangible seal is weaker than the perimeter seal. Thus the desired peeling or rupturing of the frangible seal may be achieved if the frangible seal is weaker than the perimeter seal; independent of the mechanism of seal failure (e.g., delamination, rupture, differential peel, interfacial peel, or the like).

For example, the frangible seal may have a seal strength from about 130 to about 5,000 grams per inch, but conveniently for youth applications the seal strength can be between about 400 grams per inch up to about 2500 grams per inch and most preferably from 1,000 to 2,000 grams per inch. The package may be designed such that a seal breaking force of between about 1,500 grams per inch and about 10,000 grams per inch is exerted on some or all of the frangible seal length upon sustained manual compression producing a pressure increase within the separated compartment confining the liquid beverage or fluid of from about 0.5 psig to about 10 psig or such that a seal breaking force of between about 400 grams per inch and about 6,000 grams per inch is exerted on some or all of the frangible seal length upon sustained manual compression producing a pressure increase within the separated compartment confining the liquid of from about 0.5 psig to about 5 psig. Even higher seal strengths and seal breaking forces may be contemplated for pouch and beverage applications operable by adults wherein the sustained manually induced pressure rise may approach 12 psig or even higher.

The sheets of polymeric film employed to make the sidewalls of the flexible multiple-compartment pouch or beverage container can be either a single layer or multilayer polymeric film. The sheets of film may be different in structure (e.g., one layer can be clear and the other can be opaque). Any such film grade polymeric resin or material as generally known in the art of packaging can be employed. A multilayer polymeric film structure can be employed. A multilayer polymeric sheet may have certain layers, for example, an outermost structural or abuse layer, an inner barrier layer, and an innermost layer, and optionally one or more adhesive or tie layers there between. The innermost layer making contact with and compatible with the intended contents of the pouch can form both the lock up perimeter seals (i.e., seal strengths typically greater than 1,500 gram/inch) and internal frangible seal(s). The innermost layer can also be heat-sealable.

The outermost structural or abuse layer can be oriented polyester, oriented polypropylene, oriented nylon, or paper. This layer can be reverse-printable and unaffected by the sealing temperatures used to make the pouch and chambers, since the pouch is sealed through the entire thickness of the multilayer structure. The thickness of this layer can be such to control the stiffness of the pouch, and may range from about 10 to about 60 μm, or about 50 μm.

The inner layer can include one or more barrier layers, depending on which atmospheric conditions (oxygen, humidity, light, and the like) that potentially can affect the product inside the pouch. Barrier layers can be metallized oriented polypropylene or oriented polyethylene terephthalate, ethylene vinyl alcohol, aluminum foil, nylon or biaxial oriented nylon, blends or composites of the same as well as related copolymers thereof. Barrier layer thickness may depend on the sensitivity of the product and the desired shelf life.

The innermost layer of the package can be the sealant selected to have minimum effect on taste or color of the contents, to be unaffected by the product, and to withstand sealing conditions (such as liquid droplets, grease, dust, or the like). The sealant can be a resin that can be bonded to itself (sealed) at temperatures substantially below the melting temperature of the outermost layer so that the outermost layer's appearance will not be affected by the sealing process and will not stick to the jaws of the sealing bar. Sealants used in multilayer pouches can include ethylene copolymers, such as low density polyethylene, linear low density polyethylene, metallocene polyethylene, or copolymers of ethylene with vinyl acetate or methyl acrylate or copolymers of ethylene and acrylic acid or methacrylic acid (optionally ionomerized such as partially neutralized with metal ions such as Na, Zn, Mg, or Li), or polypropylene copolymers. Sealant layers can be about 25 to about 100 μm thick. The sealant can also form a side compartment which ruptures and bursts by squeezing, i.e. a frangible seal.

The frangible seal can be produced by heat-sealing the single sheet or either sheet of the multi-sheet of the film. The inner surface of at least one or both of the polymeric films can comprise a blend of (a) 80 to 93 weight percent of an ethylene/acid ionomer wherein at least 50 weight percent of the ethylene/acid ionomer is derived from ethylene comonomer and wherein the degree of neutralization of acid is from 5 to 45 percent and (b) 20 to 7 weight percent of a propylene/α-olefin copolymer wherein the α-olefin comonomer comprises 1 to 12 weight percent of the copolymer. The frangible seal can also be a blend of (a) an acid modified ethylene vinyl acetate copolymer or acid modified ethylene methyl acrylate copolymer as the major component and (b) a partially neutralized ethylene acid ionomer as the minor component; a blend of (a) a partially neutralized ethylene acid ionomer or ethylene acid copolymer as the major component and (b) polybutene-1 homopolymer or copolymers as the minor component; or a blend of (a) a metallocene polyethylene as the major component and (b) polypropylene or polybutene-1 homopolymer or copolymers as the minor component.

The frangible seal may be formed by heat-sealing together the inner surface of a single sheet of film (e.g., multilayer film), which has been folded over so that two portions of one principal face of the sheet are in contact, or heat-sealing together the inner surfaces of two superimposed multilayer sheets of polymeric film each having the innermost sealant layer made from a resin, which undergoes interfacial peel sealing having different seal strengths when the heat seals are formed at different temperatures. Such resins include blends of one or more polyolefins such as polyethylene including metallocene polyethylene with polybutylene or polypropylene including homopolymer or copolymers thereof (collectively: PE/PB blends; PE/PP blends); polypropylene with polybutylene (PP/PB blends); polypropylene with ethylene methacrylic acid copolymer (PP/EMAA blends); or polypropylene with styrene-ethylene/butylene-styrene block terpolymer (PP/SEBS blends). The frangible seal can also be produced by zone coating the innermost layer in the region of the seal with a sealant or by heat sealing two dissimilar sealing surfaces such as an ionomer and ethylene copolymer. Blends of an ionomer based on partial neutralization of an ethylene acrylic acid copolymer or ethylene methacrylic acid copolymer with a polypropylene α-olefin copolymer (ethylene/acrylic acid copolymer or EMAA ionomer blended with a PP/PB copolymer) can be used as the innermost sealant layer because the blends are reliable in forming lockup or frangible seals, depending on sealing conditions. Such ionomer with polypropylene copolymer blends exhibiting predictable peel strength over an extended heat seal temperature range are disclosed in U.S. Pat. Nos. 4,550,141 and 4,539,263, herein incorporated by reference in their entirety. These polymeric blends when employed in the flexible multiple-compartment beverage pouch involve the inner surface of each of the polymeric films being a blend of (a) 80 to 93 weight % of an ethylene/acid ionomer wherein the ionomer may be dipolymer or a terpolymer and at least 50 weight % of the ethylene/acid ionomer is derived from ethylene comonomer and typically more than 8 weight percent is derived from acid comonomer and wherein the degree of neutralization of acid is from about 5 to about 45% and (b) 20 to 7 weight % of a propylene/α-olefin copolymer wherein the α-olefin comonomer comprises 1 to 12 weight % of the copolymer.

As disclosed in U.S. Pat. No. 4,550,141, the selection of the amount of ethylene/methacrylic acid (EMAA) ionomer and propylene/ethylene copolymer employed as the blend making up the innermost sealant layer can determine the peel strength of the frangible seal as a function of interface "heat-seal" temperature being employed in making the frangible seal using from about 5 weight % PP/E (3% E) copolymer up to about 20 weight % blended with EMAA ionomer (15% MM; 22% neutralization with Zn). At lower PP/E copolymer loading (e.g., 8%) the onset of a heat seal plateau of about 800 to 1070 g/in seal strength across the temperature range of about 90 to 120° C. may progress as a function of increased loading of PP/E copolymer (e.g., 20%) to a heat seal plateau of about 130 to 400 g/in seal strength across the temperature range of about 80 to 140° C. Using this information or similar data measured by one skilled in the art relative to alternate sealant blends, the composition of the innermost sealant layer can be easily selected along with selecting a heat-seal temperature for fabricating the frangible seal, such as to produce a frangible seal with a predictable and desired range of peel force at rupture.

In order to manufacture a frangible seal containing at least one force concentrating means for selectively exceeding the seal strength of the frangible seal various alternative methodologies are contemplated. Shape and/or curvature of the frangible seal can be employed to concentrate the forces created when the container or pouch is manually compressed or squeezed. Also, the geometry and/or variable width of the (heated) heat seal bar employed to heat seal the frangible seal can be employed to produce a force concentrating means. Time-temperature sealing methods can also be employed to make a frangible seal containing a force concentrating means for selectively exceeding the seal strength of the frangible seal. For example, repetitive and/or multiple strikes of different heat seal bars can produce a frangible seal with variable seal strength that then serves as an equivalent structure to the claimed force concentrating means for selectively exceeding seal strength of said frangible seal.

For measuring the seal strength, 4 inch by 6 inch samples of the polymeric film can be cut with the long side of the samples in the machine direction of the film. Enough film samples provide one set of three specimens for each heat seal condition. The films then can be folded so that the sealant layer of each side contacts the other. The film is then heat sealed between the jaws of the heat sealer at the appropriate temperature, time and pressure. The heat-sealed samples are then conditioned for at least 24 hours at 73° F. and 50% relative humidity before testing. The folded over portion of the sealed film can be cut in half, forming suitable flaps to be placed in the Instron jaw clamps. One inch specimens are then cut in the machine direction of the film to provide at least three 1 inch wide test specimens at each set of sealing conditions.

The seal strength can be measured by pulling the seals apart in the machine direction of the film using the Instron at 5 inches/minute jaw speed. In other instances, a pull rate of 12 inches/minute on the Instron may also be employed. The maximum force required to cause the seal to fail is then recorded, and the average of at least three specimens is reported in grams/25.4 mm (i.e., grams/inch).

Other particularly preferred blends of polymers for use as the frangible seal forming innermost layer include a combination of an ethylene vinyl acetate (EVA) copolymer or acid modified EVA copolymer and an ethylene methyl acrylate (EMA) copolymer or acid modified EMA as the major component and a polypropylene homopolymer or copolymer, a polybutylene homopolymer or copolymer, a partially neutralized ethylene acid ionomer or mixture of the ionomer with metallocene polyethylene as the minor component. Such polymers and blends are available commercially as sealants from E. I. du Pont de Nemours and Company under the tradenames Appeel®, Bynel®, Elvax®, Nucrel® and Surlyn®. Again, additives including, for example, slip, antiblock, and/or chill roll release agents and the like can be used. Using these acid modified EVA and EMA based blends in combination with various other polymeric film layers, the heat seal strength can selectively range from 300 g/in up to 3,000 g/in with a lock-up heat seal strength in excess of 3,000 g/in.

During the manufacture of the polymeric film sheet to be used in making the pouch, co-extrudable adhesives are optionally used between functional layers to adhere the layers to each other and to provide structural integrity. These include but are not limited to, polymers and copolymers of ethylene or propylene modified with or grafted with unsaturated carboxylic acid groups such a maleic anhydride or maleic acid and the like. Also, to provide additional thickness (if desired by the consumer for a particular application), bulk layers of polyolefin or chopped remnants of the multilayer film trimmed during pouch fabrication can be incorporated within the multilayer structure. The sheet of polymeric film (e.g., the so-called "web stock") may be produced using any combinations of the processes generally known in the art, such as monolayer or multilayer casting, blowing film, extrusion lamination, and adhesive lamination and combinations thereof. Processing aids known in the art including slip agents (such as amide waxes), antiblocking agents (such as silica), and antioxidants (such as hindered phenols), may be incorporated in the stock to facilitate either manufacture of the film or pouch formation. Pouches are formed from web stock by either cutting and heat sealing separate pieces of web stock or by a combination of folding and heat sealing with cutting. Pouch making equipment such as that made by Totani Corporation, Kyoto, Japan or Klockner Barlelt Co., Gordonsville, Va. can be used. The frangible compartment can be installed either during or after pouch formation. It should be further appreciated that the heat sealed perimeter of the pouch can be achieved by superimposing the first and second sheets of polymeric film and then heat sealing each directly to the other or heat sealing them indirectly through the use of an intervening third polymeric film, again as generally known and practiced in the art.

A mechanism to allow the consumer easy access to the contents beverage pouch can be achieved by insertion of a straw or preferably by use of a fitment or spout, such as those sold by Menshen Packaging USA, Waldwick, N.J. or Portola Packaging, San Jose, Calif. The fitment or spout can be sealed inside the top or side of the pouch. The fitment or spout is molded from a material that can be sealed to the pouch by induction, heat, or laser energy. The sealing can be done before or after filling the pouch, depending on the equipment used. Preferably when the fitment is employed for youth beverage pouch applications, the fitment is childproof such as disclosed in U.S. Pat. Nos. 6,138,849 and 6,991,140, both incorporated herein by reference in their entirety.

Similarly, the flexible multiple-compartment pouch embodiment can be provided with a mechanism to allow the consumer easy access to the contents of the pouch and as such the pouch embodiment can serve as a beverage pouch. For example, the pouch can be provided with an opening system, which can be pierced by a straw (i.e., a so-called straw hole or piercing opening) as generally known in the art (see e.g., U.S. Pat. Nos. 5,425,583, 5,873,656, and 6,116,782, incorporated herein by reference in their entirety.

EXAMPLES 1-18

In the examples below, a five layer co-extruded blown film was produced on a five layer blown film line to make an outer layer of LDPE of melt index 0.3 and density 0.918 g/cc, and adjacent adhesive layer of an anhydride modified polyethylene (Bynel® 4104), a barrier layer of an ethylene vinyl alcohol (Eval® F101A), a second adhesive layer of an anhydride modified polyethylene (Bynel® 41E687), and an inner sealant layer containing a melt blend of 10 weight percent random polypropylene copolymer of melt flow rate 7 and melt point 135° C. and 90 weight percent ethylene ionomer terpolymer containing 10 weight percent methacrylic acid and 10 weight percent isobutyl acrylate with 15% of the acid groups neutralized by zinc. The LDPE was melted at 219° C. in a 63.5 mm single screw extruder operating at 62 rpm. The EVOH was melted at 211° C. in a 50.8 mm single screw extruder operating at 27 rpm. Bynel® 4104 was melted at 215° C. in a 50.8 mm single screw extruder operating at 34 rpm. Bynel® 41E687 was melted at 196° C. in a 50.8 mm single screw extruder operating at 12 rpm. The ionomer blend was melted at 223° C. in a 63.5 mm single screw extruder operating at 13 rpm. The blown film was corona treated on the PE layer and laminated to a 48 gauge oriented polyester (Mylar® LBT). The PE layer was 71 microns, the adhesive layers were 8 microns each, the barrier layer was 13 microns and the inner sealant layer was 28 microns. The film was then heat sealed to itself with 3 mm wide heat seal bars, with both bars heated at a pressure of 275 kilo-Pascals and at the temperatures and dwell times described in the examples. The films were then tested on the Instron, as described earlier, with the Instron being pulled at 12 inches/minute. As can be seen from these examples, the level of heat seal strength can be readily controlled by application of the appropriate temperature and time to make the seal, and thus the required seal strength to provide frangibility at about 5000 gm/inch or less, or to provide lock up seals at 8000 gm/inch or greater. The resulting data are presented in the following Table 1.

TABLE 1

| Example | Dwell Time (seconds) | Bar Temp (° F.) | Heat Seal Strength (g/inch) |
|---|---|---|---|
| 1 | 0.5 | 200 | 340 |
| 2 | 0.75 | 200 | 497 |
| 3 | 0.75 | 240 | 6325 |
| 4 | 0.5 | 200 | 229 |
| 5 | 0.75 | 200 | 531 |
| 6 | 1 | 200 | 1042 |
| 7 | 1 | 240 | 9975 |
| 8 | 0.75 | 240 | 9932 |
| 9 | 0.5 | 240 | 1467 |
| 10 | 1 | 220 | 3285 |
| 11 | 0.75 | 220 | 1770 |
| 12 | 0.5 | 240 | 1697 |
| 13 | 1 | 200 | 1306 |
| 14 | 1 | 240 | 9617 |
| 15 | 0.5 | 220 | 1078 |
| 16 | 1 | 220 | 3306 |
| 17 | 0.75 | 220 | 1694 |
| 18 | 0.5 | 220 | 942 |

EXAMPLES 19-26

In the examples below, similar five layer co-extruded blown films were produced on a commercial blown film line to make similar structures to those described in Examples 1-18. For these examples, the films had an outer layer of LLDPE, an adjacent adhesive layer of an anhydride modified polyethylene (Bynel® 41E687), a barrier layer of an ethylene vinyl alcohol (Eval F101A), a second adhesive layer of an anhydride modified polyethylene (Bynel® 41E687), and an inner sealant layer containing a melt blend of 10 weight percent random polypropylene copolymer of melt flow rate 7 and melt point 135° C. and 90 weight percent ethylene ionomer terpolymer containing 10 weight percent methacrylic acid and 10 weight percent isobutyl acrylate with 15% of the acid groups neutralized by zinc. The blown film was either 100 or 125 microns thick. The 100-micron thick film comprised of the LLDPE layer at 53 microns, the tie layer at 5 and 7 microns, respectively, the EVOH layer at 10 microns and the ionomer layer at 25 microns. The 125-micron thick film comprised of the LLDPE layer at 65 microns, the tie layers at 5 and 7 microns respectively, the EVOH layer at 15 microns and the ionomer layer at 33 microns. Both films were corona treated on the PE layer and laminated to a 48 gauge oriented polyester (Mylar® LBT). The films were then made into pouches similar to that described in FIG. 6 on a commercial Totani pouch machine. The various conditions at which the frangible chamber was manufactured are described in the Table 2 below. One-inch wide strips containing the frangible seal were cut perpendicular to the vertical frangible seal compartment. Ten such strips taken from five pouches of each example were subsequently tested on the Instron at 12 inches/minute, with the average reported in the column labeled heat seal strength. The internal pressure required to rupture the frangible chamber of these pouches were tested as follows. A bulkhead fitting of a 0.25 inch male pipe thread with ⅛ inch compression was affixed to the main chamber of the pouch, and connected by ⅛ inch tubing to a Sensotech model #7/1786-08 pressure transducer. During testing, the output of this transducer was fed into a Sensotech model # 2310 signal amplifier and plotted using the appropriate computer software. The pouch was filled with water in the main chamber, and then sealed completely so that no leakage occurred in the vicinity of the valve or in the perimeter seals. The pouch was placed on a circular 5 and ⅞ inch platen lower jaw of the Instron, and the upper twin jaw was then exerted onto the pouch at a rate of 2 inches/minute until the frangible seal between the two chambers ruptured. The maximum internal pressure required to burst the frangible seal was then recorded. The column in the table below reflects the average of three such readings for each example.

As can be seen from these examples 18 through 26, the level of heat seal strength can be readily controlled by application of the appropriate temperature and time to make the seal. The internal pressure to burst the frangible seal without rupturing the outermost perimeter seals of the pouch varied from 0.6 psig to 8.3 psig.

TABLE 2

| | | Frangible seal bar conditions | | | |
|---|---|---|---|---|---|
| Example | Blown Film Thickness, microns | Bar temperature, ° F. | Dwell time, msecs | Heat Seal Strength gm/25 mm | Pressure to burst Frangible chamber psig |
| 19 | 100 | 260 | 700 | 822 | 0.9 |
| 20 | 100 | 290 | 700 | 1286 | 1.7 |
| 21 | 100 | 300 | 500 | 1704 | 0.6 |
| 22 | 100 | 320 | 500 | 5444 | 5.7 |
| 23 | 100 | 325 | 400 | 2070 | 1.2 |
| 24 | 125 | 310 | 700 | 1396 | 1.5 |
| 25 | 125 | 320 | 700 | 2246 | 4.4 |
| 26 | 125 | 320 | 600 | 3597 | 8.3 |

The benefits and advantages of the invention include the following. First, it provides an easily fill, easily ruptured, but robust multiple compartment pouch that can be manufactured inexpensively using conventionally known commercial equipment. The pouch and/or individual beverage drink container provides a method for retaining various contents and components within the package temporarily isolated from each other and subsequently commingled at the user's discretion. This in turn affords the opportunity to produce a variety of novel and aesthetically pleasing effects and benefits when using the packaging system. In fact it is felt that the arbitrary number, size, shape, and sequential controlled rupturing of frangible seals afforded the user by virtue of the instant invention, represents a virtually unlimited breadth of novel packaging alternatives and aesthetic functional effects.

The invention claimed is:

1. A flexible multiple-compartment container comprising (1) a single sheet of polymeric film or multi-sheet of polymeric film and (2) at least one frangible seal wherein the polymeric film is single layer or multilayer;

the single sheet is folded back on itself and sealed along essentially the superimposed edges directly or indirectly through a third intervening polymeric film thereby defining a first sealed perimeter and forming a closed pouch; or wherein the multi-sheet comprises at least a first sheet of polymeric film and a second sheet of polymeric film;

the second sheet is superimposed on the first sheet;

the first sheet and the second sheet are sealed to each other directly or indirectly through a third intervening polymeric film thereby defining a second sealed perimeter and forming the closed pouch; and wherein the frangible seal is formed by heat-sealing together the inner surface of the polymeric film;

the frangible seal is internal to the first sealed perimeter or the second sealed perimeter and the frangible seal divides the closed pouch into separated compartments comprising a first compartment and a second compartment;

the frangible seal comprises a curved portion and variable width that follows the path of the curved portion with a maximum width near the segment of the curved portion having the smallest radius of curvature;

the first compartment comprises or confines a fluid;

the second compartment comprises or confines another ingredient; and wherein the first sealed perimeter or the second sealed perimeter has a seal strength sufficient to withstand manual compression of the fluid and the seal strength of the frangible seal is insufficient to withstand manual compression of the fluid, thus allowing the fluid of the first compartment to commingle with the other ingredient of the second compartment.

2. The container of claim 1 wherein the first sealed perimeter or the second sealed perimeter of the container has a first end, a second end, and two opposed sides; and the frangible seal extends from the first end to the second end.

3. The container of claim 2 being a pouch and further comprising a fitment.

4. The container of claim 1 wherein the first sealed perimeter or the second sealed perimeter of the container has a first end, a second end, and two opposed sides; and the frangible seal extends from one opposed side to the other opposed side.

5. The container of claim 4 being a pouch and further comprising a fitment.

6. The container of claim 1 wherein the first sealed perimeter or the second sealed perimeter of the container has a first end, a second end, and two opposed sides; and the frangible seal extends from the first end to one of the opposed sides.

7. The container of claim 6 being a pouch and further comprising a fitment.

8. The container of claim 7 wherein the pouch is a standup pouch.

9. The container of claim 1 being a pouch and further comprising a fitment.

10. The container of claim 1 wherein the frangible seal delaminates upon sustained manual compression producing a pressure that increases within the first compartment and the pressure is optionally up to 12 psig or from 0.5 psig to 2.0 psig; and wherein the frangible seal intersects the sealed perimeter at an angle between 70 and 110 degrees and the frangible seal near the intersection is shaped with increased width.

11. The container of claim 1 wherein the frangible seal has a seal strength of from 130 to 5,000 g/inch or 1,000 to 2,000 g/inch.

12. The container of claim 1 wherein the frangible seal experiences a seal breaking force of between 400 grams per inch and 6,000 grams per inch upon sustained manual compression producing a pressure increase within said first compartment or said second compartment of from 0.5 psig to 5.0 psig.

13. The container of claim 1 wherein the frangible seal contains at least one force concentrating means for selectively exceeding said frangible seal's seal strength by experiencing a seal breaking force of from 1,500 grams per inch up to 10,000 grams per inch at a pressure increase within said first compartment or said second compartment of from 0.5 psig to 10 psig.

14. The container of claim 1 wherein the frangible seal is produced by heat-sealing the first surface of the single sheet of film or by heat-sealing the first surface of the first sheet of polymeric film to the first surface of the second sheet of polymeric film;

the first surface of the single sheet, the first sheet, or the second sheet comprises a blend; and the blend comprises (a) 80 to 93 weight % of an ethylene/acid ionomer and 20 to 7weight % of a propylene/α-olefin copolymer; (b) an acid modified ethylene vinyl acetate copolymer or acid modified ethylene methyl acrylate copolymer as the major component and a partially neutralized ethylene acid ionomer as the minor component; (c) a partially neutralized ethylene acid ionomer as the major component and polybutene-1 homopolymer or copolymers as the minor component; or (d) polypropylene or polybutene-1 homopolymer or copolymers as the minor component.

15. The container of claim 14 wherein the first sealed perimeter or the second sealed perimeter of the container has a first end, a second end, and two opposed sides; and the frangible seal extends from the first end to the second end.

16. The container of claim 14 wherein the container is a pouch comprising a fitment.

17. The container of claim 14 wherein the container is a standup pouch.

18. A flexible multiple-compartment pouch comprising (1) a heat-sealable single sheet of polymeric film or multi-sheet of polymeric film and (2) at least one frangible seal wherein the polymeric film is single layer or multilayer;

the single sheet is folded back on itself and sealed along essentially the superimposed edges directly or indirectly through a third intervening polymeric film thereby defining a first sealed perimeter and forming a closed pouch; or wherein the multi-sheet comprises at least a first sheet of polymeric film and a second sheet of polymeric film;

the second sheet is superimposed on the first sheet;

the first sheet and the second sheet are sealed to each other directly or indirectly through a third intervening polymeric film thereby defining a second sealed perimeter and forming the closed pouch; and wherein the frangible seal is formed by heat-sealing together the inner surface of the polymeric film;

the frangible seal is internal to the first sealed perimeter or the second sealed perimeter and the frangible seal divides the closed pouch into a first compartment and a second compartment; and the frangible seal comprises a curved portion and variable width that follows the path of the curved portion with a maximum width near the segment of the curved portion having the smallest radius of curvature thereby providing at least one force concentrating means for selectively exceeding seal strength of said frangible seal by experiencing a seal breaking force of from 1,500 grams per inch up to 10,000 grams per inch at a pressure increase within at least one of said separated compartments of from 0.5 psig to 10 psig.

19. The pouch of claim 18 wherein the polymeric film of the single sheet, the first sheet, or the second sheet comprises a blend; and the blend comprises (a) 80 to 93 weight % of an ethylene/acid ionomer and 20 to 7 weight % of a propylene/α-olefin copolymer; (b) an acid modified ethylene vinyl acetate copolymer or acid modified ethylene methyl acrylate copolymer as the major component and a partially neutralized ethylene acid ionomer as the minor component; (c) a partially neutralized ethylene acid ionomer as the major component and polybutene-1 homopolymer or copolymers as the minor component; or (d) polypropylene or polybutene-1 homopolymer or copolymers as the minor component.

20. The pouch of claim 19 wherein the first sealed perimeter or the second sealed perimeter of the pouch has a first end, a second end, and two opposed sides; the frangible seal extends from the first end to the second end, or from one opposed side to the other opposed side, or from the first end to one of the opposed sides; and the pouch optionally comprises a fitment.

* * * * *